United States Patent [19]

Vagner

[11] 4,312,598

[45] Jan. 26, 1982

[54] HOUSEHOLD APPLIANCE FOR CLEANING FLOORS, WINDOWS AND OTHER WASHABLE SURFACES

[76] Inventor: Lucienne Vagner, 29/33, rue Claude Tillier, 75012 Paris, France

[21] Appl. No.: 120,311

[22] Filed: Feb. 11, 1980

[30] Foreign Application Priority Data

Feb. 15, 1979 [FR] France ..... 79 03879

[51] Int. Cl.[3] ..... A47L 1/00; A46B 11/08; A47L 13/32; A47L 13/16

[52] U.S. Cl. ..... 401/1; 401/140; 401/206; 401/263; 401/270; 401/272; 401/273; 401/274; 401/275; 401/278; 401/290; 401/207

[58] Field of Search ..... 401/1–3, 401/23, 24, 48, 205, 206, 263, 264, 275, 270–274, 278, 279, 140

[56] References Cited

U.S. PATENT DOCUMENTS

| | | | |
|---|---|---|---|
| 1,138,772 | 5/1915 | Matthews | 401/273 |
| 1,894,420 | 1/1933 | Ranish | 401/275 |
| 1,972,318 | 9/1934 | Rosenberg | 401/206 |
| 2,517,152 | 8/1950 | Wilson | 401/273 |
| 2,974,349 | 3/1961 | Cassia | 401/206 |

FOREIGN PATENT DOCUMENTS

| | | | |
|---|---|---|---|
| 401273 | 8/1910 | Austria | 401/273 |
| 272261 | 10/1968 | Austria | 401/264 |
| 2513299 | 10/1976 | Fed. Rep. of Germany . | |
| 2549376 | 9/1977 | Fed. Rep. of Germany | 401/1 |
| 621493 | 2/1927 | France | 401/206 |
| 1247167 | 10/1960 | France . | |
| 1597362 | 7/1970 | France . | |
| 2139654 | 1/1973 | France . | |
| 2230322 | 12/1974 | France | 401/1 |
| 2321258 | 3/1977 | France . | |
| 237595 | 9/1945 | Switzerland | 401/206 |
| 357843 | 12/1961 | Switzerland . | |

*Primary Examiner*—Steven A. Bratlie

[57] ABSTRACT

This appliance which provides instantaneous cleaning and immediate drying comprises a handle, at one end of which is hinged a heating sole protected by a cover, in combination with a swab made from any absorbing material held under this heating sole as well as with means for feeding water to the lower face of the heating plate in contact with the swab. The heating sole- protecting cover assembly has at least one opening, and said means are formed by a water reservoir placed above said cover and comprising at least one appendage housed in said opening, this appendage having at its base at least one flow orifice for the water. Means such as a piston and springs are provided for maintaining this orifice normally closed and for opening it when it is desired to damp the swab in contact with the heating sole.

11 Claims, 5 Drawing Figures

HOUSEHOLD APPLIANCE FOR CLEANING FLOORS, WINDOWS AND OTHER WASHABLE SURFACES

BACKGROUND OF THE INVENTION

Floors are generally cleaned with water, to which appropriate products may possibly be added. But, after such a washing, they are easily dirtied as long as they have not dried, which requires a long time more or less depending on the thermal and hygrometric conditions, and leads, if the floors are subjected to intense traffic, to their washing being undertaken only during times when this traffic is less intense, which is a constraint limiting considerably the possibilities of washing and therefore not allowing them to be as carefully maintained as may be desired.

The present invention provides a household appliance for cleaning floors which avoids this drawback and which is also applicable to the cleaning of windows and other washable surfaces.

SUMMARY OF THE INVENTION

This household appliance is of the type which comprises a handle, removable or not, at one end of which there is hinged a heating sole protected by a cover said sole and said cover constituting an assembly hereinafter called the sole-cover assembly, in combination with a swab held under this heating sole, the word swab being understood in its widest sense and designating any absorbing substance, made from textile, animal, vegetable or synthetic fibers, from paper or from any other material, as well as in combination with means for feeding water to the lower face of the heating sole in contact with the swab; these means comprise a water reservoir placed above said cover and at least one opening provided in the sole-cover assembly, in the direction of the swab, said reservoir comprising at least one appendage housed in said opening, this appendage having at its base at least one flow orifice for the water from the reservoir and means being provided for maintaining this orifice normally closed and for opening it when it is desired to damp the swab in contact with the heating sole. This appliance is characterized in that said means for closing and opening an orifice of an appendage of the reservoir are return springs, fixed to the upper face of said cover and through which the reservoir rests on the cover, so that said appendage of the reservoir extends in said opening of the sole-cover assembly up to the level of the heating sole, a piston is disposed in the reservoir at right-angles to said orifice and comprises a rod and a head, the upper end of the rod being slidable with an easy fit in a guide secured to the walls of the reservoir in the upper region thereof, whereas the head rests like a valve on the internal edge of said orifice, a compressed coil spring is fitted over the rod of the piston, bearing under said guide, on the one hand, and on the upper face of the head of the piston, on the other hand, and maintaining this latter normally applied against the internal edge of said orifice to close this latter, and a stop pin is integral with the lower face of the head of the piston, passing through said orifice and extending approximately as far as the level of the heating sole.

Said return springs may be blade springs, spiral springs, coil springs, and said guide may be a tube secured to the internal face of the upper wall of the reservoir, facing said orifice, or a plate passing through the reservoir parallel to the base thereof, fixed to two opposite walls of the reservoir and having therethrough a hole through which the rod of the piston slides with an easy fit. Several tubes are provided or several holes are provided in the plate, when there are several pistons.

The water from the reservoir, to which a detergent or bleach may be added, is vaporized and spreads in the swab applied against the heating plate and, when the appliance is moved over the floor or any other washable surface in contact therewith, it dissolves and carries along with it all the dirt which is absorbed by the swab, thus providing proper cleaning with instantaneous drying, and that without requiring the addition to the water of aggressive products likely in the long run to damage the cleaned surface.

Said opening may be a slit or an aperture of any shape and several openings may be provided in the sole-cover assembly, said reservoir then comprising a corresponding number of appendages. Each appendage may have at its base several flow orifices for the water from the reservoir.

A sealing joint is advantageously placed on the internal edge of each orifice, to provide a complete seal between this edge and the head of the corresponding piston.

With the cleaning appliance of the invention placed on the floor, all that is required is to press, for example with one's foot, the top of the reservoir, against the action of said return springs, to bring the lower end of said stop pin in contact with the floor (with swab interposed), at the bottom of said opening, which raises said piston against the action of said coil spring and opens said orifice, the water from the reservoir then flowing towards and into the swab under the heating plate, which vaporizes it. The flow is selectably adjustable through the duration of the compression exerted on the reservoir. When the pressure is released, the return springs bring the reservoir up again above said cover, the piston moves down again and the head of the piston again closes said orifice under the effect of the coil spring.

The handle of the appliance is provided preferably with a shock absorber, in the form of a coil spring or a sleeve made from elastomer or another flexible material, in its lower region likely to knock into furniture and skirting boards.

The heating sole may be of any type and any appropriate means may be used for carrying it and maintaining it at the desired temperature. Generally heating resistances are used housed in the sole and connectable to the mains by means of a supply cord.

Hollows and projections may be provided on the lower face of the sole for improving the distribution of the steam above the upper face of the swab, and for creating steam turbulences; these turbulences have a very efficient action for causing the dirt to be removed from the floor and absorbed by the swab. These hollows and projections may result from rough portions moulded into the lower face of the heating sole, these rough portions holding furthermore, without fixing it, the swab against the sole by simple contact during movement of the appliance over the floor. To change the swab, all that is required is to raise the appliance and to set it down to one side on a clean swab. For fixing the swab to the sole, which is particularly useful when the appliance is used with the heating sole in a vertical position for washing windows, a hook-shaped curving up of the corners of the heating sole may be provided.

These corners may also be curved downwards to form additional anchoring points for the swab under the sole.

A variation of the appliance provided for washing windows has its reservoir divided into two communicating compartments, a rear compartment and a front compartment, by means of a dividing wall comprising a first part extending transversely, substantially perpendicularly to the face of the reservoir turned towards the cover and leaving at its top a passage for communication between the two compartments which it defines, and a second part extending substantially perpendicularly to the first part from the top thereof and, towards, but without reaching, the front face of the reservoir so as to leave a passage for communication between said rear and front compartments, said piston being located in the rear compartment and the guide in which the upper end of the rod of the piston slides being the second part of said dividing wall, having therethrough for this purpose a hole at right-angles to the piston, the reservoir being pivotably mounted by the lower edge of its front face on a plate integral with the cover and a cord being secured to the rear face of the reservoir and maintained for sliding along the handle of the appliance, when it is pulled to bring the reservoir close to the cover, in order to actuate said piston.

When the front compartment of the reservoir which supplies the swab with liquid is empty, the appliance is put into a vertical position with the handle pointing upwards, then it is turned over 180 degrees, which causes the liquid in the rear compartment to pass into the front compartment of the reservoir and thus allows the whole of the liquid to be used. The apparatus may then again be used for washing windows; since it is generally held vertical for this purpose, the hinging of the reservoir to the plate maintains this reservoir on the appliance.

The above and other objects, features and advantages of the present invention will become apparent from the following description, given solely by way of non-limiting illustration, when taken in conjunction with the accompanying drawings.

DESCRIPTION OF THE PREFERRED EMBODIMENTS

Figure 2:
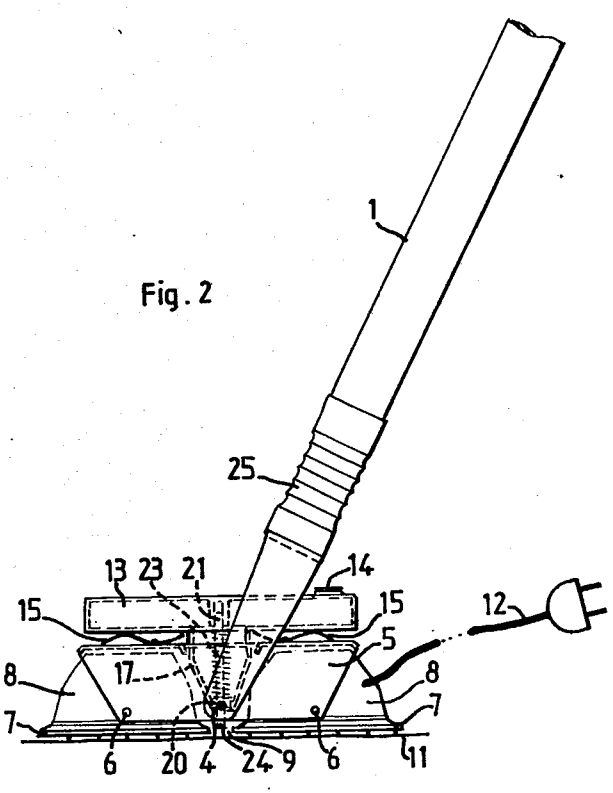
FIG. 2 is a side elevational view.
Figure 1:
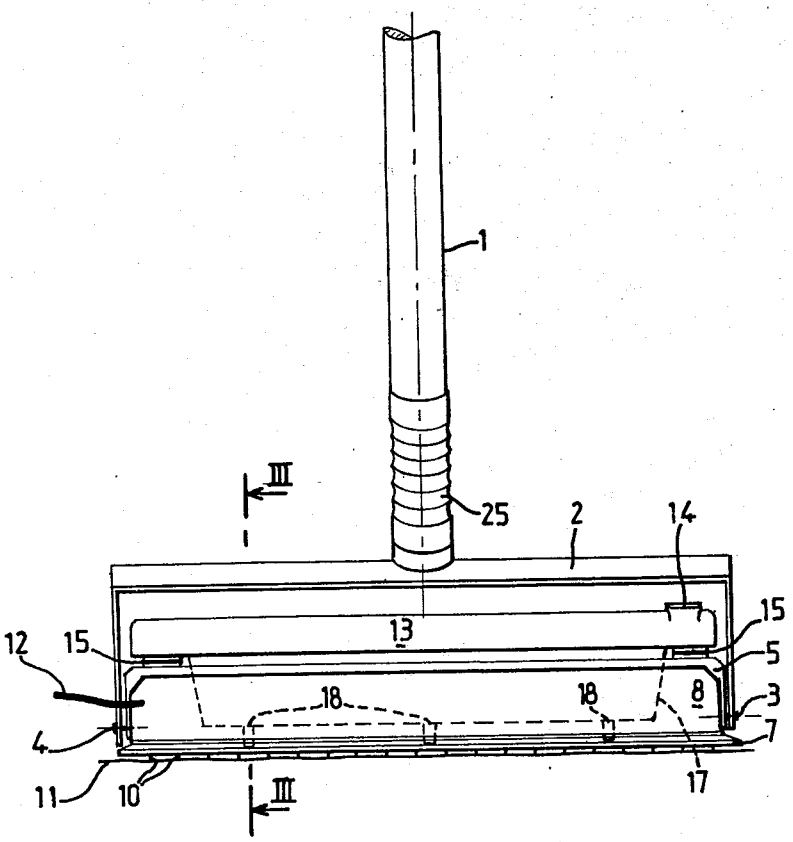
FIG. 1 is a front elevational view of a first embodiment for washing floors.

The appliance shown in FIGS. 1 to 4 comprises a handle 1 having at its lower end a stirrup-piece 2 hinged at 3 and 4 to a substantially U-shaped plate 5, on the legs of which are secured by means of rivets 6 two assemblies each formed by a heating sole 7 and a cover 8, these two assemblies being mounted between the two legs of the U, parallel to one another and spaced apart so as to leave therebetween an opening 9. The lower face of each sole 7 has sharp pointed integrally moulded rough portions 10 which hold a swab 11 under the sole, when the appliance is placed on the floor on such a swab, then is moved over the floor. Each sole 7 is heated, for example by means of incorporated electrical resistances supplied by means of an electric cord 12 which is connected to the mains. Each cover 8 is a sealed protecting cover.

The swab 11 placed on the ground is then held under the heating soles 7 by means of said rough portions forming hollows and projections on the lower face of the soles and by means of the weight of the appliance itself. The outer corners of soles 7 could be slightly curved towards the floor to form complementary anchoring points for swab 11, or be curved upwards (as at 29 in FIG. 5) for forming hooks for fixing the swab which, in practice, are only useful in the case of an appliance for washing windows (such as the one shown in FIG. 5), because it works in a vertical position.

A removable reservoir 13 fillable under a tap through an orifice closed by a plug 14 contains a reserve of water to which a cleaning product may be added.

This reservoir 13 is placed on the hinging plate 5 by means of return blade springs 15 fixed at a few points, for example by welding or riveting, on the edges of the upper face of plate 5. Thus, reservoir 13 in the rest position is maintained raised above plate 5 (FIGS. 2 and 3).

This plate is cut away at 16 in its central region (FIGS. 3 and 4) so that a median appendage 17 extending reservoir 13 downwards may pass through opening 9 as far as heating soles 7. The base of appendage 17 has flow orifices 18 therethrough for the liquid from the reservoir.

Figure 3:
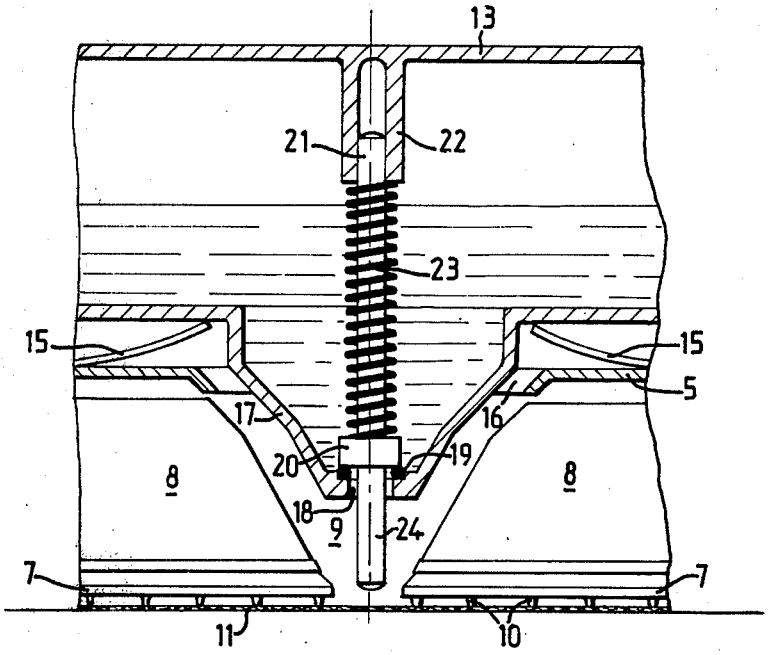
FIG. 3 is an enlarged partial sectional view along line III—III of FIG. 1.
Figure 4:
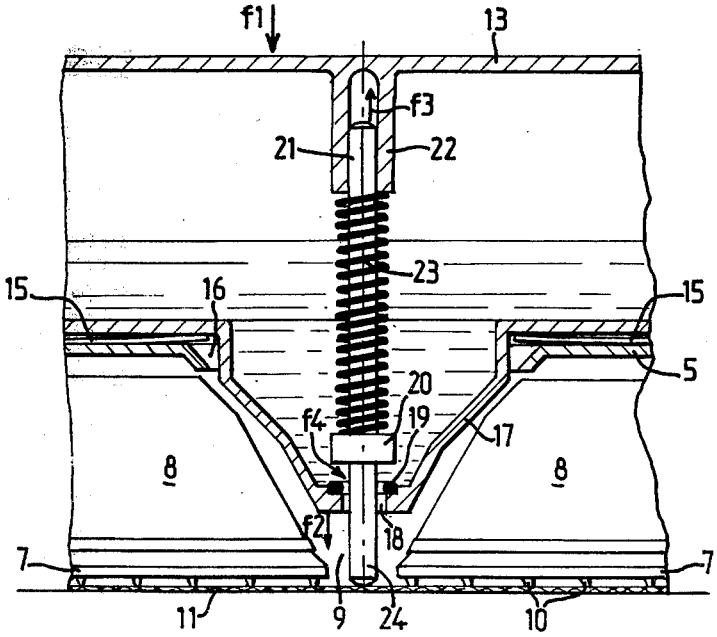
FIG. 4 is a view similar to FIG. 3 showing how the appliance operates when the swab is being damped.

The internal edge of each orifice 18 is fitted with a seal 19 and the orifice is closed by the head 20 of a piston, whose rod 21 may slide at its upper end in a guide 22 integral with the inner face of the upper wall of reservoir 13, at right-angles to orifice 18 (FIG. 3). A compressed coil spring 23 is fitted over rod 21 and, bearing against the base of guide 22 and on the top of head 20, it applies this latter on seal 19 which closes orifice 18. A flow of liquid from the reservoir through opening 9 towards heating plates 7 and swab 11 (see FIG. 4) is obtained at will by pressing at $f_1$ on the top of reservoir 13, either with one's foot, or with any appropriate mechanical means. The head 20 of each piston is extended by a stop pin 24 passing through orifice 18 and extending approximately as far as the heating soles 7. Under the effect of the pressure applied at $f_1$, against the action of return springs 15 which are flattened, the reservoir moves down into opening 9 as shown by arrow $f_2$, each pin 24 touches the swab and the floor, then, with further pressure, each piston is raised, its rod 21 sliding as shown at $f_3$ in guide 22, orifice 18 is freed and the liquid flows as shown at $f_4$.

When the pressure on the upper part of the reservoir 13 is released, return springs 15 bring reservoir 13 back above plate 5 and coil springs 23 reapply the heads 20 of the pistons to seals 19.

The advantage of such a device is that it allows the user himself to control the period of flow, so the amount of water wetting the swab, depending on the nature of the floors, their state of dirtiness and the flow speed of the liquid.

A shock absorber 25 surrounds handle 1 above stirrup-piece 2. This shock absorber may be in the form of a spring, or a sleeve made from elastomer or any other flexible material. Handle 1 may be in one piece or in several pieces which may be fitted together.

Figure 5:
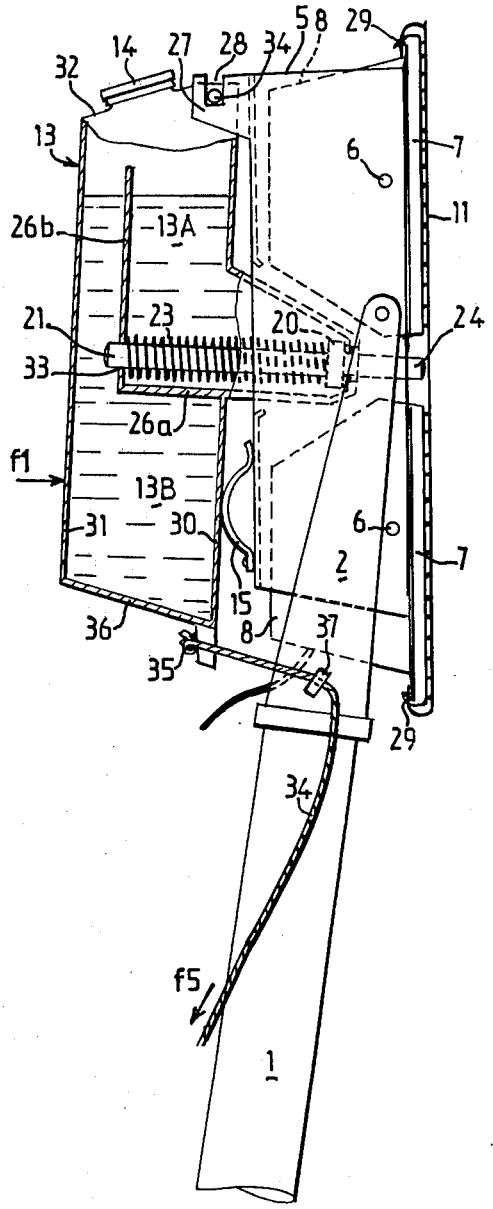
FIG. 5 is a side view, partially in elevation with parts cut away and partially in section, of another embodiment of the appliance for washing windows.

The appliance shown in FIG. 5 is for cleaning windows and so works in a vertical position. All its parts similar to those of the appliance of FIGS. 1 to 4 bear the same reference numbers.

Reservoir 13 is divided into a rear compartment 13B and a front compartment 13A, communicating therebetween, by means of a dividing wall 26 comprising a first part 26*a* extending transversely, substantially perpendicularly to the face 30 of the reservoir turned towards cover 8 and not reaching the opposite face 31 of the reservoir, so as to leave at its top a passage for communication between the two compartments 13B and 13A, and a second part 26*b* extending transversely, substantially perpendicularly to the first part 26*a* at the top thereof, towards the front face 32 of the reservoir, but without reaching this face, to leave a passage for communication between said compartments 13B and 13A. The piston 20-21-24 with its coil spring 23 is located in the front compartment 13A and the second part 26*b* of dividing wall 26 has a hole 33 therethrough at right-angles to the piston for forming the guide, in which the upper end of rod 21 of the piston slides.

Plate 5 has on each side of the appliance an extension 27 along the reservoir in the vicinity of the front face 32 thereof; each extension is notched at 28 and the reservoir is provided on each side of its front face with a pivot 34 insertable into said notch 28, the reservoir being thus pivotably mounted on plate 5 and being held on the appliance when this latter is in a vertical position. The reservoir 13 remains however removable. A cord 34 is fixed at 35 to the base of the rear face 36 of reservoir 13 and is maintained for sliding along handle 1 by passing under guide clips 37. Swab 11 may be damped either by pressing with one's hand on reservoir 13 in the direction of arrow $f_1$, if cleaning is being carried out at an accessible height, or by pulling cord 34 in the direction of arrow $f_5$; in both cases, reservoir 13 pivots on its pivot shafts 34 at the bottom of notches 28 in plate 5 and it draws near to covers 8, against the action of the blade spring(s) 15, provided only under the rear compartment 13B of the reservoir; the piston(s) 20-21-24 are then actuated in the same way as for the appliance for washing the floor and the water flows from the reservoir for damping swab 11. In this embodiment, it is sufficient to place return springs 15 under the rear compartment 13B of the reservoir. The curved corners 29 of soles 7 hold swab 11 in place.

The dividing wall 26 allows all the liquid from the reservoir to be used. In fact, only the liquid contained in the front compartment 13A is used for damping the swab but, when this compartment is empty, it is sufficient to turn the appliance upside down for a few seconds, while pulling cord 34 in the direction of arrow $f_5$ to hold reservoir 13 against plate 5; the liquid which filled the rear compartment 13B then passes into front compartment 13A and remains in this compartment, when the appliance is placed head up; thus the whole of the capacity of the reservoir can be advantageously used.

With a few minor modifications, the appliance for washing floors is thus adaptable for washing windows or other vertical surfaces or surfaces sloping at any angle from the horizontal.

It will be readily understood that the embodiments of the invention which have just been described above, with reference to the accompanying drawings, have been given purely by way of indication and are in no way limiting and that numerous modifications in the field of technical equivalents may be made, without departing from the scope or spirit of the present invention. Thus, for example, water reservoir 13 could be slidably mounted inside handle 1 with a return spring and even form a constituent part thereof, or it could be formed from a lower part which would be fixed to the blade return springs instead of being removable, and another higher part which would be housed in the handle, would be connected to the lower part by means of a flexible hose and through which filling would be carried out, and the swabs could be fixed to the heating sole by any appropriate means while still being readily changeable when they are dirty. As for the adjective "household", it must not be considered as being restrictive, the present appliance being able to be constructed in any size and particularly in sizes for use for industrial cleaning purposes.

What is claimed is:

1. A household appliance for cleaning floors, windows and other washable surfaces comprising a handle, at one end of which is hinged a heating sole protected by a cover, said sole and said cover constituting an assembly hereinafter called the sole-cover assembly, in combination with a swab held under this heating sole, the word swab being understood in its widest sense and designating any absorbing substance made from textile, animal, vegetable or synthetic fibres, from paper or from any other material, as well as in combination with means for feeding water to the lower face of the heating sole in contact with the swab, these means comprising a water reservoir placed above said cover and at least one opening provided in the sole-cover assembly, in the direction of the swab, said reservoir comprising at least one appendage housed in said opening, said appendage having at its base at least one flow orifice for the water from the reservoir and means being provided for maintaining this orifice normally closed and for opening it when it is desired to damp the swab in contact with the heating sole, wherein said means for closing and opening the orifice of the appendage of the reservoir are return springs fixed to the upper face of said cover and by means of which the reservoir rests on the cover, so that said appendage of the reservoir extends into said opening of the sole-cover assembly as far as the level of the heating sole; a piston disposed in the reservoir at right angles to said orifice and comprising a rod and a head, the upper end of the rod being slidingly mounted with an easy fit in a guide secured to a wall of the reservoir in the upper region thereof, whereas the head rests like a valve on an internal edge of said orifice; a compressed coil spring fitted over the rod of the piston and bearing under said guide and on the upper face of the head of the piston, and maintaining said head normally applied to the internal edge of said orifice to close the latter; and a stop pin integral with the lower face of the head of the piston passing through said orifice and extending approximately to the level of the heating sole.

2. The appliance as claimed in claim 1, wherein several openings are provided in the sole-cover assembly and said reservoir comprises a corresponding number of appendages.

3. The appliance as claimed in claim 1, wherein a seal is placed on the internal edge of said orifice to provide complete sealing between this edge and the head of the piston.

4. The appliance as claimed in claim 1, wherein rough portions forming reliefs and hollows are provided on the lower face of the heating sole to retain the swab against the sole by simple contact.

5. The appliance as claimed in claim 1, wherein the corners of the heating sole are curved to form anchorage points for the swab.

6. The appliance as claimed in claim 4, wherein the corners of the heating sole are curved to form anchorage points for the swab.

7. The appliance as claimed in claim 1, wherein said guide is a tube secured to the internal face of the upper wall of the reservoir, opposite said orifice.

8. The appliance as claimed in claim 4, wherein said guide is a tube secured to the internal face of the upper wall of the reservoir, opposite said orifice.

9. The appliance as claimed in claim 5 for washing windows, wherein the reservoir is divided into two communicating compartments, a rear compartment and a front compartment, by means of a dividing wall comprising a first part extending transversely, substantially perpendicularly to the face of the reservoir turned towards the cover and leaving at its top a passage for communication between the two compartments which it defines, and a second part extending substantially perpendicularly to the first part from the top thereof and towards, but without reaching, the front face of the reservoir, so as to leave a passage for communication between said rear and front compartments, said piston being located in the front compartment and the guide in which the upper end of the rod of the piston slides being the second part of said dividing wall, having therethrough for this purpose a hole at right angles to the piston; said reservoir is pivotably mounted, through the lower edge of its front face, on a plate integral with the cover; and a cord is secured to the rear face of the reservoir and is maintained in sliding relation along the handle of the appliance, when it is pulled in order to bring the reservoir close to the cover, in order to actuate said piston.

10. The appliance as claimed in claim 9, wherein rough portions forming reliefs and hollows are provided on the lower face of the heating sole.

11. The appliance as claimed in claim 1, wherein said guide comprises a hole in said wall of the reservoir through which the rod slidingly passes with an easy fit, said wall passing through the reservoir parallel to the base thereof.

* * * * *